US005201354A

United States Patent [19]

Weissbeck

[11] Patent Number: 5,201,354

[45] Date of Patent: Apr. 13, 1993

[54] FEED SYSTEM WITH IMPROVED PREPOSITIONING

[75] Inventor: Larry M. Weissbeck, Vancouver, Wash.

[73] Assignee: U.S. Natural Resources, Inc., Vancouver, Wash.

[21] Appl. No.: 807,108

[22] Filed: Dec. 13, 1991

[51] Int. Cl.[5] ..... B27B 1/00; B27B 31/00; B27C 1/12

[52] U.S. Cl. ..... 144/245 A; 83/367; 144/242 R; 144/242 D; 144/242 E; 144/242 H; 144/249 A; 144/357; 198/469.1; 198/801

[58] Field of Search ..... 144/242 R, 242 C, 242 E, 144/242 M, 245 A, 249 A, 356, 242 H; 83/367, 365, 419, 520; 364/474.02, 474.09, 474.13, 474.32, 474.34; 198/457, 469.1, 801

[56] References Cited

U.S. PATENT DOCUMENTS

| | | | |
|---|---|---|---|
| 3,970,128 | 7/1976 | Kohlberg | 144/245 A |
| 4,340,137 | 7/1982 | Foster | 144/242 M |
| 4,413,662 | 11/1983 | Gregoire et al. | 144/245 A |
| 4,977,805 | 12/1990 | Corley et al. | 144/357 |

FOREIGN PATENT DOCUMENTS 2916828 11/1990 Fed. Rep. of Germany ... 144/242 C

*Primary Examiner*—W. Donald Bray
*Attorney, Agent, or Firm*—Robert L. Harrington

[57] ABSTRACT

A feed system with improved preposition is shown and describe wherein a prepositioning stage is located vertically above a feed stage such that movement of a wood product from the prepositioning stage to the feed stage corresponds to movement of the wood product through a transfer path having orientation corresponding to that of the height dimension of the wood product. This prepositioning configuration provides relatively more efficient movement of the wood product along its transfer path from a prepositioning stage to a feed stage as compared to prior methods where the transfer path is horizontal and the wood product moves in a direction corresponding to its relatively greater width dimension. The vertical orientation of the transfer path as provided by a prepositioning stage above a feed stage also allows for more efficient sequencing of mechanical events within the system to further contribute to improved productivity. The system illustrated thereby maintains the complexity and yield advantages of modern wood processing equipment, but improves the productivity in terms of overall piece count capability of the system.

15 Claims, 3 Drawing Sheets

FEED SYSTEM WITH IMPROVED PREPOSITIONING

BACKGROUND OF THE INVENTION

This invention relates generally to wood processing apparatus, and particularly to a prepositioning system providing improved piece count.

Modern wood processing systems have developed significantly beyond those systems used when wood resources were plentiful. With attenuated raw material resources comes the need for improved recovery in wood processing systems. Wood processing system design has responded to this need by optimizing yield in product recovery. Systems have incorporated computer controlled processes in high yield, high efficiency systems. The prepositioning of a wood product relative to a feedline of a cutting device is known. It is well established that even slight skewing of a wood product when necessary, relative to a given feedline can improve significantly the yield of the system. Improved recovery may be in the form of maximized dollar return or maximized production of given wood products. In either case, wood processing apparatus has become more complex to achieve such optimization of yield.

One aspect of this increased complexity in wood processing apparatus relates to the use of a computer system to first model a wood product, e.g., as by automated scanning, and then determine a preferred position for the wood product relative to a feedline along which the wood product moves into a cutting device. The selection of a preferred position for the wood product relative to the feedline may be determined according to a variety of methods, typically an automated process under computer control. The computer programming uses the information provided by the scanning system to adjust the position of the wood product when necessary to achieve a yield optimization. Such computerized yield optimization has also made use of prepositioning systems allowing the system to begin the process of scanning and calculating a preferred position for the wood product while the preceding wood product moves along the feedline into the cutting device.

By introducing the mechanical and control functions of scanning and prepositioning, the wood processing systems have necessarily become more complicated. In such complicated machinery the sequencing of individual components to accomplish movement of a wood product through the system becomes critical. In many cases, the additional mechanical features required to accomplish optimized yield have affected other aspects of productivity. Thus, while the use of scanners, computers and prepositioning features have provided improved yield, the complexity introduced by such systems has, in many cases, reduced the overall throughput or piece count capability of the wood processing system. Each wood product must be individually manipulated and tracked as it moves through the processing apparatus. With emphasis on manipulation and precise positioning of individual wood products, the overall processing time for each wood product increases and system productivity, in terms of throughput, decreases.

Movement from stage-to-stage within the system requires time, and time for movement of wood products through the system translates into reduced throughput. Accordingly, time savings in moving a given wood product from one stage to the next stage can result in increased productivity, i.e., greater overall piece count.

Even slight savings of time, sometimes on the order of fractions of a second for a given step within the system, can amount to significant overall improvement in machine productivity.

Also, such complex wood processing machines require sequencing of certain mechanical actions in order to accomplish movement of the wood products through the system. In many cases the events must, by virtue of the physical and logical organization of the machine, occur according to a given time table or with reference to certain positioning or movement of the wood product. As the ordered sequence of mechanical actions becomes more complicated, the overall processing time for each wood product increases. Savings in terms of consolidation of steps, i.e., simultaneous execution, or overlapping of steps, i.e., initiation of one step prior to completion of another step, can streamline the overall process of wood product production and, therefore, improve overall productivity.

The subject matter of the present invention, therefore, relates to wood processing apparatus including scanning and prepositioning systems for orientation of a wood product relative to a feedline along which the wood product moves in order to improve yield. The present invention provides, in such wood processing apparatus, relatively greater overall productivity in terms of piece count while maintaining the optimized yield advantages of the system.

SUMMARY OF THE INVENTION

A preferred embodiment of the present invention in a first aspect is a wood product feed system providing improved overall piece count and, therefore, improved productivity. In the preferred embodiment, the feed system receives a flow of wood products and accomplishes the steps of scanning and identification of a preferred orientation of the wood product relative to a feedline. The wood product is delivered to a prepositioning stage in an orientation corresponding to that of the preferred position of the wood product relative to the feedline, but offset from that preferred position along a transfer path. A conveyor system moves the wood product along the transfer path from the prepositioning stage to a feed stage whereat the wood product achieves the preferred position relative to the feedline.

In accordance with the preferred embodiment of the present invention, the prepositioning stage is vertically disposed directly above the feed stage whereby the transfer path length is a function of wood product height. In contrast to prior methods of prepositioning and movement to a feed stage by movement of the wood product through a transfer path corresponding to the width of the wood product, the present invention provides improvement in that the time required to move the wood product through its height is less than the time required to move it through its width. Accordingly, the time required to move a wood product from its prepositioning stage downward to its feed stage is relatively less and overall productivity is increased.

In accordance with another aspect of the present invention, by provision of the transfer path of the present invention certain sequencing steps are streamlined to reduce the overall processing time required for each wood product. In accordance with this time savings, overall productivity is further improved.

In the preferred embodiment of the present invention as illustrated herein, a feed system is improved by use of retractable stabilizing elements movable into and out of the transfer path between the prepositioning stage and the feed stage. More particularly, and as illustrated by example herein, the present invention may be embodied in a feed system wherein wood products are received and scanned, a preferred position for each wood product is identified relative to a feedline, the wood products are prepositioned at a prepositioning stage, and a conveyor moves the wood products along a transfer path to a feed element carrying the wood products along the feedline. The point at which the feed element accepts the wood products from the conveyor defines the feed stage. By provision of a stabilizing element, as provided by the present invention, movable into and out of the transfer path, the wood product may be moved along the transfer path with the stabilizing element retracted therefrom and once the wood product passes the stabilizing element the stabilizing elements may be extended to engage the wood product prior to its deposit on the feed element. In the illustrated embodiment of the present invention, the feed element corresponds to a feed chain defining the feedline and the stabilizing elements correspond to retractable press rollers horizontally movable into and out of a vertical transfer path.

The subject matter of the present invention is particularly pointed out and distinctly claimed in the concluding portion of this specification. However, both the organization and method of operation of the invention, together with further advantages and objects thereof, may best be understood by reference to the following description taken with the accompanying drawings wherein like reference characters refer to like elements.

BRIEF DESCRIPTION OF THE DRAWINGS

For a better understanding of the invention, and to show how the same may be carried into effect, reference will now be made, by way of example, to the accompanying drawings in which.

DETAILED DESCRIPTION OF THE PREFERRED EMBODIMENT

Figure 1:
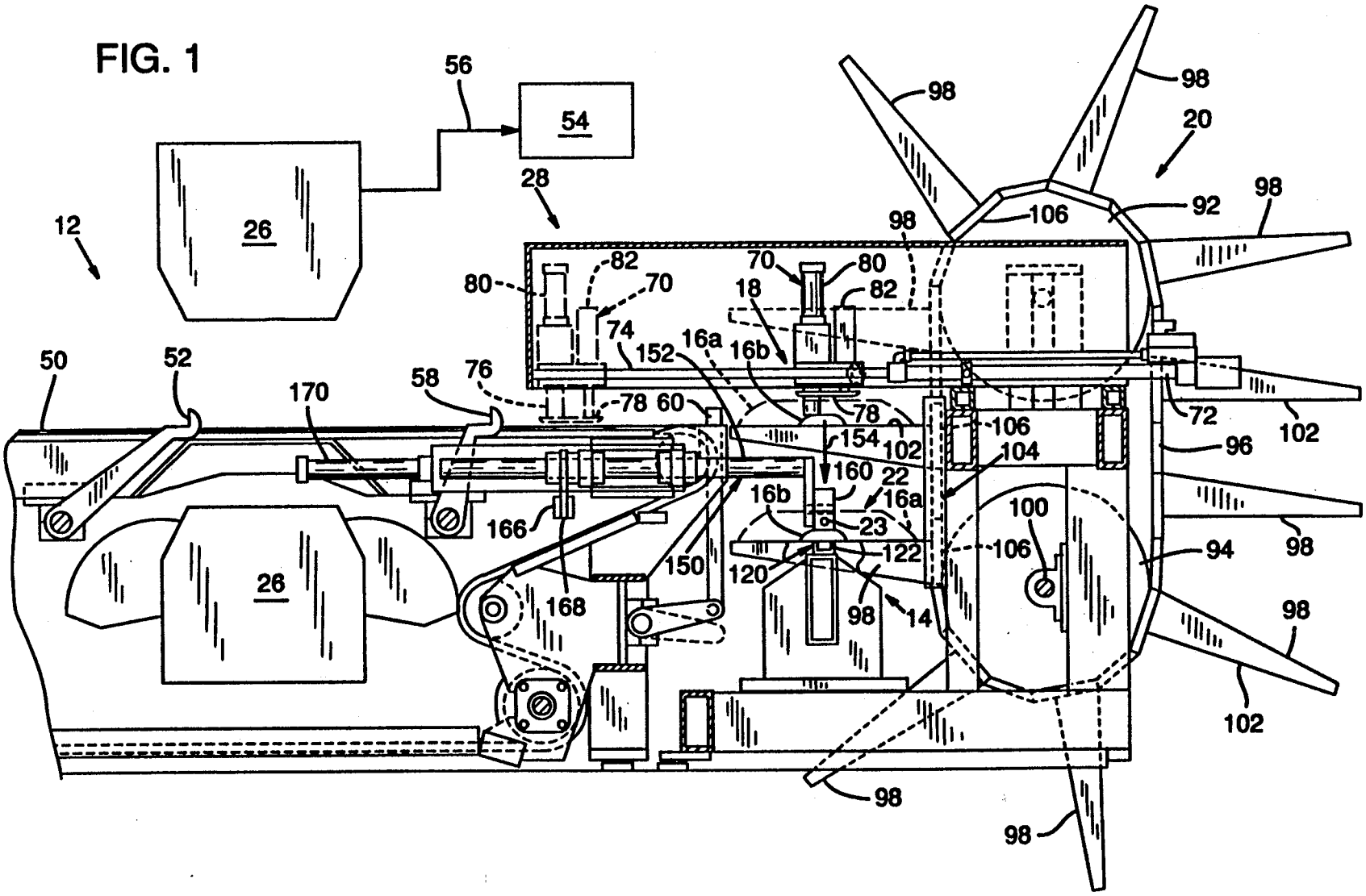
FIG. 1 illustrates a side view of an infeed portion and an end view of and outfeed portion of a feed system according to a preferred embodiment of the present invention.

The preferred embodiment of the present invention as illustrated in the drawings comprises generally a feed system with improved prepositioning of wood products, i.e., flitches, including scanning of the wood products and prepositioning of the wood products relative to a feed path for optimal recovery. It will be understood that application of the present invention is best utilized in an automated computer controlled wood processing apparatus wherein mechanical systems of the apparatus are controlled by a computer, or similar such logic control devices, in order to control precisely each processing step. In such complex computer controlled systems, it will be understood that the computer or logic control device has precise control over the actuation of the various mechanical devices and the ability to monitor the progress of each wood product through the system. While the present invention finds application in such complex computer automated systems, it will be understood, however, that the present invention shall not be limited to such complex computer controlled wood processing apparatus and may find application in other systems including those having manual control features.

A feed system of the type illustrated herein is a high efficiency system wherein slight adjustment in position of wood products relative to a feedline can result in significant overall product recovery. Furthermore, the complexity of such systems requires computerized control systems and precise timing and sequencing of various mechanical movements of the system in order to optimize the overall piece count or throughput of the system. Thus, where sequencing of certain steps of the system can be avoided or consolidated or where movement of a wood product from one reference position to another reference position can be minimized, and therefore the travel time minimize, the overall throughput of the system is improved.

The present invention relates to the process of prepositioning relative to a feed path by first scanning the wood product and determining a preferred position relative to the feedline in order to improve recovery. The overall piece count is improved in reducing the travel distance for the wood product from a prepositioning stage to a feed stage and thereby minimizing the time required for such movement and allowing the feeding of one wood product while the subsequent wood product is prepositioned. The complexity, timing, and sequencing of various mechanical elements of the system relative to prepositioning and feeding of the wood product into a cutting device are also streamlined and also contribute to improved overall piece count.

Figure 2:
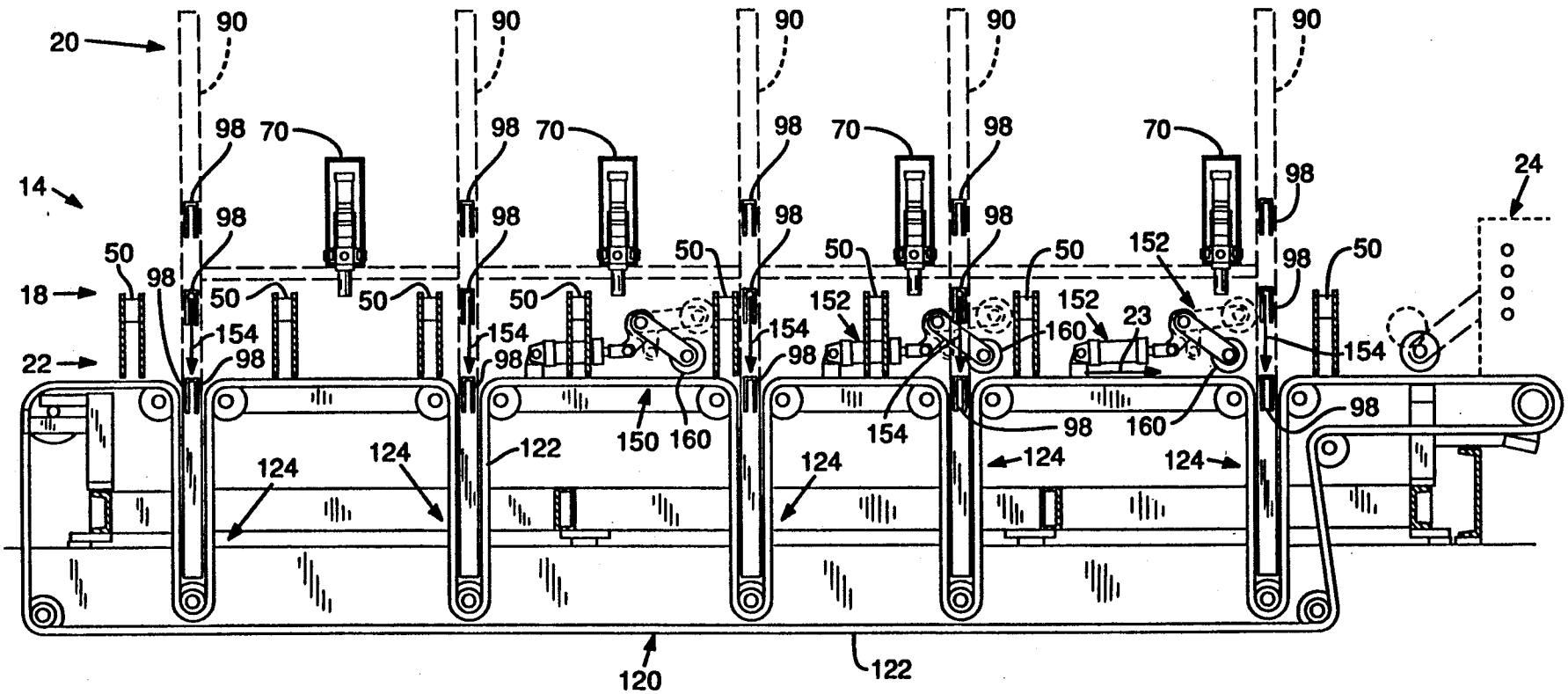
FIG. 2 illustrates a side view of the outfeed portion and an end view of the infeed portion of the feed system of FIG. 1.

With reference to FIGS. 1 and 2, the preferred embodiment of the present invention includes an infeed system 12, shown in side view in FIG. 1, and an outfeed system 14, shown in side view in FIG. 2. The infeed system 12 moves flitches 16 to a prepositioning stage 18. The infeed system 12 includes a scanning arrangement 26 through which the flitches 16 pass for computer modeling in order to determine a preferred position relative to the feedline 23. A conveyor system 20 moves the flitches 16 from the prepositioning stage 18 to a feed stage 22. In FIG. 1, the flitches 16*a* as shown at the prepositioning stage 18 and feed stage 22 represent the largest flitch envelope for which the illustrated system is designed, and the flitches 16*b* at the prepositioning stage 18 and the feed stage 22 represent the minimum flitch envelope for which the illustrated system is designed. Once delivered to the feed stage 22, the outfeed system 14 moves the flitches 16 along the feedline 23 toward a cutting system 24.

The scanning arrangement 26 allows the system to identify a preferred position of a given flitch 16 relative to the feedline 23, generally designated as a lateral position and skew of the flitch 16 relative to feedline 23. The infeed system 12 includes a prepositioning system 28 for establishing a positional relationship between each flitch 16 and the feedline 23 as it is deposited at the prepositioning stage 18. More particularly, the positional relationship of each flitch 16 as deposited at the prepositioning stage 18 is vertically offset relative to its preferred position at the feed stage 22. The conveyor system 20 maintains this positional relationship as it moves downward to the feed stage 22 such that upon delivery at the feed stage 22 the flitch 16 is located in its preferred position relative to the feedline 23

In accordance with the present invention, overall throughput of the illustrated feed system is improved over that of prior systems in several respects. Primarily, it will be noted that the prepositioning stage 18 of the preferred embodiment is vertically offset relative to the feed stage 22. Also, the flitch 16 height dimension, typically the least magnitude dimension of the flitch 16 excluding length, is vertically oriented whereby movement of the flitch 16 from the prepositioning stage 18 to the feed stage 22 may be minimized. Travel distance of each flitch 16 from stage 18 to stage 22 thereby need only correspond to the height dimension of the flitch. In prior prepositioning methods the flitch is moved horizontally through the larger magnitude width dimension from a prepositioning location to a feed location. Also, as will be apparent from the following description, by virtue of the movement of each flitch 16 from the prepositioning stage 18 to the feed stage 22 certain sequencing steps are consolidated to reduce the overall processing time required for each flitch 16.

As a result of these time savings, the overall efficiency of the system in terms of throughput, i.e., piece count, is greatly improved. It is believed that the overall piece count can be improved, according to the present invention, by as much as 30% relative to prior methods of prepositioning and transfer to a feed stage in prior feed systems.

A more detailed description of the illustrated feed system follows with reference to the movement of a given flitch 16 through the infeed system 12, conveyor system 20 and outfeed system 14.

Infeed system 12 includes a number of chains 50, shown individually in end view in FIG. 2, for carrying the flitches 16 laterally through the scanning arrangement 26 and toward the prepositioning system 28 for delivery at the prepositioning stage 18. A queue stop 52 positioned at the inlet to scanning arrangement 26 insures that one flitch at a time passes through the scanning arrangement 26. As the flitch 16 passes through the scanning arrangement 26, scanning arrangement 26 delivers data 56 to a process control 54. Process control 54 uses data 56 to identify a preferred position of the flitch 16 relative to the feedline 23. A second queue stop 58 at the inlet to prepositioning system 28 insures that but one flitch 16 at a time enters the prepositioning system 28. Upon release by the queue stop 58, a flitch 16 moves into the prepositioning system 28 and comes to bear against a set of vertically retractable stop pins 60. The chains 50 run continuously and hold the flitch 16 against pins 60.

The prepositioning system 28 includes a set of positioning heads 70 each individually horizontally positioned under the influence of a corresponding hydraulic cylinder 72. More particularly, each positioning head 70 is mounted for horizontal freedom of movement, e.g., as by a horizontal track mounting arrangement, and fixedly attached to the rod 74 of the corresponding cylinder 72. Each of cylinders 72 is operated under the influence of control 54 whereby the positioning heads 70 may be selectively positioned relative to one another and moved in unison relative to the prepositioning stage 18.

Each positioning head 70 includes a vertically retractable flitch edge engaging pin 76 and a flitch engaging shoe 78. The pin 76 and shoe 78 are selectively moved vertically by operation of corresponding pneumatic cylinders 80 and 82, respectively. The cylinders 80 and 82 are selectively individually operated under the influence of control 54.

Once the flitch 16 enters the prepositioning system 28 and comes to bear against stop pin 60, the stop pin 60 drops and the flitch 16 advances slightly into the prepositioning stage 18 Two of the positioning heads 70 of prepositioning system 28 are then selected for skewing and lateral shifting the flitch 16 according to the preferred position of flitch 16 relative to the feedline 23. More particularly, as a function of the length of a given flitch 16 only two positioning heads 70 are required to move the flitch 16 toward the prepositioning stage 18.

The selected positioning heads 70 relatively offset in order to achieve a given skew for the flitch and moved in unison toward stage 18 to laterally shift the flitch 16 onto the prepositioning stage 18. Thus, two of the cylinders 80 are actuated to drop the corresponding pins 76 on the remote side of the flitch 16, i.e., the side most distant from the prepositioning stage. Control 54 maintains relative positioning of the selected pins 76 by operation of the associated cylinders 72 in order to achieve a desired skew of the flitch 16 as the positioning heads 70 move toward the prepositioning stage 18 under the influence of the associated cylinders 72. Thus, as the flitch 16 approaches the prepositioning stage 18 it moves under the influence of the selected positioning heads 70 as relatively skewed to achieve the preferred position of flitch 16 relative to feedline 23.

Once the pins 76 engage the remote edge of the flitch 16 and the desired skewing is achieved, the cylinders 82 of the selected positioning heads 70 are also actuated to drop the shoes 78 onto the upper surface of the flitch 16 for improved stability and maintenance of the skewing of flitch 16. The shoes 78 may be lowered even while the flitch remains on the chains 50. It is suggested that the speed of positioning heads 70 toward the prepositioning stage 18 be slightly greater than the speed of chain 50.

A prepositioning system similar to that of the illustrated prepositioning system 28 shown herein is disclosed in U.S. Pat. No. 4,340,137, filed Dec. 11, 1980 by T. C. Foster and entitled CANT MOVEMENT AND ALIGNING MECHANISM, the disclosure of which is incorporated fully by reference herein, and may be referenced for a more detailed description of the operation of such a prepositioning system. It will be understood, however, that a variety of prepositioning systems may be employed in the context of the present invention without departing from the scope of the present invention.

The conveyor system 20 includes a series of flight assemblies 90, individually shown schematically in FIG. 2, each including an upper support wheel 92 and a lower wheel 94. A chain 96 of each assembly 90 encircles the upper and lower wheels 92 and 94 and carries a number of outward extending flights 98 thereon. The wheels 94 are mechanically coupled to a common drive shaft 100 for coordinated movement of all flight assemblies 90. More particularly, corresponding flights 98 of each flight assembly 90 are maintained in relative position whereby the planar flitch receiving surfaces 102 of corresponding flights 98 are coplanar. Thus, by controlled rotation of the shaft 100 a set of corresponding flights 98, i.e., horizontally aligned, may be moved into the prepositioning stage 18 whereby the surfaces 102 thereof define the prepositioning stage 18 at the output of chains 50. The corresponding flights 98 are then maintained in such position at prepositioning stage 18 for receiving a flitch 16 as laterally shifted onto the flights 98 under the influence of prepositioning system 28.

As the shaft 100 further rotates, a flitch 16 resting on corresponding flights 98, as positioned at the prepositioning stage 18, is moved vertically downward to the feed stage 22 as shown in FIG. 1. A guide assembly 104 next to prepositioning stage 18 receives protruding portions 106 of each flight 98 to maintain the horizontal orientation and parallel relation of the surfaces 102 in moving from the prepositioning stage 18 to the feed stage 22.

The conveyor system 20 includes a servo motor (not shown) and associated control systems operable by process control 54 for moving the conveyor system 20 under precise control. More particularly, the acceleration, deceleration and positioning of the flights 98 of conveyor system 20 are under precise control for suitably timing the movement of flitches 16 from the prepositioning stage 18 to the feed stage 22, and for coordinated movement of other elements of the feed system in order to optimize the throughput of the overall system.

The outfeed system 14 includes a chain assembly 120 for receiving the flitches 16 from the conveyor system 20. As each flitch 16 moves vertically downward on the conveyor system 20, the conveyor system 20 drops the flitches 16 onto chain assembly 120. The flitches then move toward the cutting device 24 along the feedline 23 under the influence of chain assembly 120. The chain assembly 20 is an interrupted chain system to accommodate movement of the flights 98 through the feedline 23. Thus, chain assembly 120, in the illustrated embodiment of FIG. 2, is a single chain 122 with diversion routes 124 allowing movement of flights 98 through the feedline 23. One alternative to this form of interrupted chain assembly 120 would be a set of longitudinally spaced individual chain assemblies operated at a common speed to define the feedline 23 without requiring diversion paths 124, i.e., the flights 98 would pass between the longitudinal spacing of individual chain assemblies. Another alternative would be an assembly of feed rollers with separation as necessary between some of the rollers to allow passage of the flights 98 therebetween.

A retractable press roller system 150 maintains the flitches 16 upon the chain assembly 120 for movement along the feedline 23. The retractable press roller system 150 includes a series of press roller assemblies 152, each individually retractable into and out of the transfer path 154 between prepositioning stage 18 and feed stage 22. Thus, as a flitch 16 moves from the prepositioning stage 18, the roller assemblies 152 are retracted from the transfer path 154 in order to allow passage of the flitch 16. Once the flitch 16 is moved sufficiently along the transfer path 154, i.e., far enough to allow extension of the roller assemblies 152 back into the path 154, the roller assemblies are extended and moved into engagement with the flitch 16. Thus, upon deposit of the flitch 16 on the chain assembly 120 the press roller assemblies 152 stabilize the flitch 16 upon the chain assembly 120 for movement along the feedline 23 under the influence of chain assembly 120.

Figure 3:
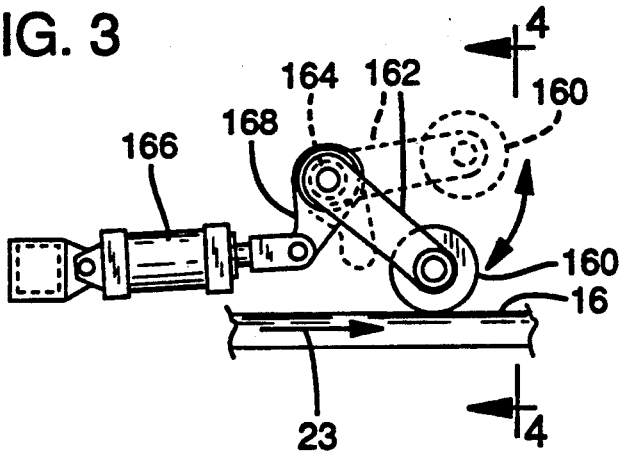
FIG. 3 illustrates a retractable press roller of the outfeed system of FIG. 2.
Figure 4:
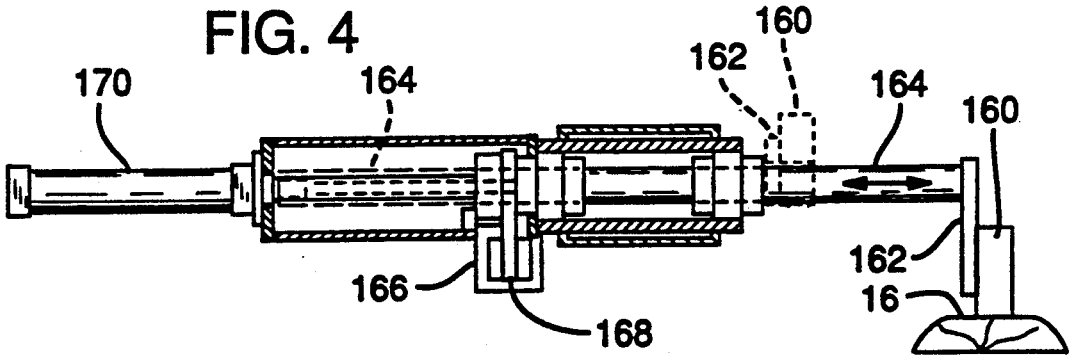
FIG. 4 illustrates the retractable press roller of FIG. 3 as taken along lines 4—4 of FIG. 3.

FIGS. 3 and 4 further illustrate each retractable roller assembly 152. FIG. 3 is a side view of a roller assembly 152 similar to that shown in FIG. 2 and FIG. 4 is a view similar to that shown in FIG. 1. In FIGS. 3 and 4, each roller assembly 152 includes an idle roller 160 rotatably mounted at the distal end of a pivot arm 162. The proximal end of arm 162 fixedly mounts upon a shaft 164. Thus, by rotational movement of the shaft 164 the idle roller 160 comes to bear against the upper surface of a flitch 16. Also, by longitudinal movement of the shaft 164 the roller 160 and arm 162 may be moved into and retracted from the transfer path 154.

A pneumatic cylinder 166 (FIG. 3) of each retractable roller assembly 152 pivotally couples to the distal end of a drive arm 168. The drive arm 168 is slidably keyed to the shaft 164 whereby a fixed angular relationship is maintained between the arms 168 and 162. The keyed relationship between arm 168 and shaft 164 allows, however, longitudinal movement of shaft 164 under the influence of pneumatic cylinder 170. The pneumatic cylinders 166 and 170 operate under the influence of process control 54. Thus, by coordinated operation of pneumatic cylinders 170 and 166 each shaft 164 and roller 160 may be selectively and individually moved into and out of the transfer path 154 and actuated to engage the upper surface of a flitch 16.

By controlling precisely the movement of each shaft 164 and roller 160 into the transfer path 154 and the rotation of the shaft 164 in order to engage the flitches 16 the rollers 160 may be moved into position against the flitches 16 as the flitches 16 move toward the feed stage 22. Thus, the rollers 160 engage and stabilize the flitch 16 before the flitch 16 is engaged by the chain assembly 120. The axes of rotation for each of rollers 160 is normal to the feedline 23 whereby upon engagement of the flitch 16 by the chain assembly 120 the flitch moves along the feedline 23 and maintained in its skewed relationship relative to the feedline 23 according to the preferred position of the flitch as determined by control 54.

In overall operation, it may be appreciated that given the precise control available over the system by use of control 54 and scan assembly 26 the movement of flitches 16 through the feed system as described herein may be implemented according to known practice.

It will be appreciated that the present invention is not restricted to the particular embodiment that has been described and illustrated, and that variations may be made therein without departing from the scope of the invention as found in the appended claims and equivalents thereof.

What is claimed is:

1. An improvement in a wood processing apparatus providing prepositioning of a wood product at a prepositioning stage according to a preferred position of the wood product relative to a feedline along which the wood product moves into a cutting device, the improvement comprising:

an infeed, scanning and prepositioning system determining a preferred position of a wood product relative to the feedline and delivering the wood product at a prepositioning stage offset from said preferred position along a transfer path; and a conveyor system moving the wood product along the transfer path from the prepositioning stage to a feed stage and into said preferred position, the transfer path being substantially parallel to a least magnitude of one of height and width dimensions of the wood product.

2. An improvement according to claim 1 wherein said least magnitude dimension is a height dimension of said wood product and said conveyor system moves the wood product vertically downward along said transfer path from said prepositioning stage to said feed stage.

3. An improvement according to claim 1 wherein said wood processing apparatus includes a feed chain defining said feedline and said improvement further includes retractable press rollers movable into and out of said transfer path.

4. An improvement according to claim 3 wherein at least one of said retractable press rollers comprises:

a shaft and associated actuation member for longitudinal movement of the shaft;

an idle roller rotatably mounted at the distal end of a first arm, the proximal end of the first arm fixedly mounted to the distal end of the shaft;

a second arm coupled to said shaft in such manner to drive said shaft into rotation and to maintain a fixed angular relationship between said first arm and said second arm;

an actuator coupled to a distal end of said second arm for controlled rotation of the shaft.

5. An improvement according to claim 1 wherein said transfer path has vertical orientation and said wood product moves downward therealong toward said feed stage.

6. A feed system for moving wood product along a feedline and into a cutting device, the system comprising:

an infeed system receiving a flow of wood products, scanning each wood product received, and identifying a preferred position of each wood product relative to the feedline;

a prepositioning system receiving wood products from said infeed system and sequentially depositing each wood product at a prepositioning stage in orientation corresponding to the preferred position therefor;

a conveyor system sequentially moving each wood product along a transfer path from said prepositioning stage to a feed stage while maintaining the wood product orientation corresponding to the preferred position therefor, the transfer path being substantially parallel to a least magnitude of one of height and width dimensions of the wood product; and an outfeed system sequentially moving each wood product from the feed stage to the cutting device along the feedline.

7. A system according to claim 6 wherein said least magnitude dimension is a height dimension of said wood product and said conveyor system moves the wood product vertically downward along said transfer path from said prepositioning stage to said feed stage.

8. A system according to claim 6 wherein said wood processing apparatus includes a feed chain defining said feedline and said system further includes retractable press rollers movable into and out of said transfer path.

9. A system according to claim 8 wherein at least one of said retractable press rollers comprises:

a shaft and associated actuation member for longitudinal movement of the shaft;

an idle roller rotatably mounted at the distal end of a first arm, the proximal end of the first arm fixedly mounted to the distal end of the shaft;

a second arm coupled to said shaft in such manner to drive said shaft into rotation and to maintain a fixed angular relationship between said first arm and said second arm;

an actuator coupled to a distal end of said second arm for controlled rotation of the shaft.

10. In a wood product feed system wherein wood products are received and scanned, a preferred position for each wood product is identified relative to a feedline of the system, and the wood products are prepositioned at a prepositioning stage, an improvement comprising:

a conveyor moving the wood products along a transfer path to a feed element carrying the wood products along the feedline, the conveyor maintaining the wood product orientation relative to the feedline while moving along the transfer path; and wood product contacting stabilizing elements for holding the wood products against the feed element, the stabilizing elements being supported by first support elements movable to bring the stabilizing elements against said wood products and by second support elements movable into and out of the transfer path to clear the transfer path for passage of a wood product.

11. An improvement according to claim 10 wherein said feed element is a feed chain defining the feedline and said stabilizing elements are press rollers.

12. In a wood product feed system wherein wood products are received and scanned, a preferred position for each wood product is identified relative to a feedline of the system, and the wood products are prepositioned at a prepositioning stage, improvement comprising:

a conveyor moving the wood products along a transfer path to a feed element carrying the wood products along the feedline, the feed element being a feed chain defining the feedline, the conveyor maintaining the wood product orientation relative to the feedline while moving along the transfer path; and stabilizing elements for holding the wood products against the feed element, the stabilizing elements begin movable into and out of the transfer path, the stabilizing elements being press rollers, at least one of said press rollers comprising a shaft and associated actuation member for longitudinal movement of the shaft, an idle roller rotatably mounted at the distal end of a first arm with the proximal end of the first arm fixedly mounted to the distal end of the shaft, a second arm coupled to said shaft in such manner to drive said shaft into rotation and to maintain a fixed angular relationship between said first arm and said second arm, and an actuator coupled to a distal end of said second arm for controlled rotation of the shaft.

13. In a wood product feed system wherein wood products are received and scanned, a preferred position for each wood product is identified relative to a feedline of the system, and the wood products are prepositioned at a prepositioning stage, an improvement comprising:

a conveyor moving the wood products along a transfer path to a feed element carrying the wood products along the feedline, the conveyor maintaining the wood product orientation relative to the feedline while moving along the transfer path; and stabilizing elements for holding the wood products against the feed element, the stabilizing elements being movable into and out of the transfer path, the transfer path being vertical whereby said conveyor moves each wood product vertically downward and into said preferred position.

14. A wood product feed system according to claim 10 wherein said first support elements directly support said stabilizing elements and said second support elements directly support said first support elements.

15. A wood product feed system according to claim 14 wherein said second support elements are elongate elements which move longitudinally in movement into and out of the transfer path and rotate about their longitudinal axis in movement of said first support elements to thereby move the stabilizing elements against said wood products.

* * * * *